US007158162B2

(12) United States Patent
Kojima

(10) Patent No.: US 7,158,162 B2
(45) Date of Patent: Jan. 2, 2007

(54) HEATING CONTROL METHOD OF HEAT DEVELOPMENT RECORDING DEVICE AND HEAT DEVELOPMENT RECORDING DEVICE

(75) Inventor: Tetsuya Kojima, Kanagawa (JP)

(73) Assignee: Fuji Photo Film Co., Ltd., Kanarawa ( * ) Notice: Subject to any disclaimer, the term of this patent is extended or adjusted under 35 U.S.C. 154(b) by 221 days.

(21) Appl. No.: 11/003,843

(22) Filed: Dec. 6, 2004

(65) Prior Publication Data

US 2005/0134671 A1 Jun. 23, 2005

(30) Foreign Application Priority Data

Dec. 18, 2003 (JP) ..... P. 2003-420997

(51) Int. Cl.
*G03D 13/00* (2006.01)

(52) U.S. Cl. ..... 347/140; 347/228; 430/353

(58) Field of Classification Search ..... 347/140, 347/228; 430/350, 353
See application file for complete search history.

(56) References Cited

U.S. PATENT DOCUMENTS 6,891,557 B1 * 5/2005 Sumi et al. ..... 347/228

FOREIGN PATENT DOCUMENTS

JP 9-307767 A 11/1997

* cited by examiner

*Primary Examiner*—Huan Tran
(74) *Attorney, Agent, or Firm*—Sughrue Mion, PLLC

(57) ABSTRACT

A heating control method of a heat development recording device includes a heating step in which after start-up of the heat development recording device, a heat development section is heated to a target temperature by a plate heater, a temperature holding step in which after the temperature of the plate heater has reached the target temperature, the target temperature is held for a prescribed time, and a step in which after the target temperature has been held for the prescribed time, the heat development section is set up in the recordable state, wherein after start-up of the heat development recording device, operation history information from the time of the last start-up is collected; and after reaching the target temperature at the time of the present start-up, a temperature holding time is determined depending upon the operation history information.

7 Claims, 12 Drawing Sheets

HEATING CONTROL METHOD OF HEAT DEVELOPMENT RECORDING DEVICE AND HEAT DEVELOPMENT RECORDING DEVICE

This application is based on Japanese Patent application JP 2003-420997, filed Dec. 18, 2003, the entire content of which is hereby incorporated by reference.

BACKGROUND OF THE INVENTION

1. Technical Field of the Invention

The present invention relates to a heating control method of a heat development recording device for developing under heating a photosensitive and heat-sensitive recording material having a latent image formed therein while conveying it and to a heat development recording device.

2. Description of the Related Art

In recent years, in the medical field, a reduction of the quantity of treated wastewater is eagerly demanded from the viewpoints of environmental conservation and space saving. Thus, it is considered that technologies regarding photosensitive heat development photographic materials useful for medical diagnosis and photographic technology, which can be efficiently exposed by a laser image setter or a laser imager and are able to form clear black images having a high dissolution and sharpness, are required. According to these photosensitive heat development photographic materials, it is possible to supply a heat development processing system which is free from use of solution based treating chemicals, is simpler and does not affect consideration for the environment.

For these reasons, in recent years, heat development recording devices by a dry system without need for carrying out wet processing are watched. In these heat development recording devices, films of photosensitive and heat-sensitive recording materials (photosensitive heat-sensitive recording materials) or heat development photosensitive materials are used. Such materials will be hereinafter referred to as "heat development recording material" (sometimes referred to as "photosensitive material"). In the heat development recording device by a dry system, laser light is irradiated (scanned) on a heat development recording material to form a latent image in an exposure section; the heat development recording material is then brought into contact with heating means to achieve heat development in a heat development section; and after cooling, the heat development recording material having an image formed therein is discharged from the device. Such a dry system is able to overcome the problem of the wastewater treatment as compared with the wet processing.

The heat development recording device is mainly constructed of a conveyor for conveying a heat development recording material after forming a latent image, a heating section corresponding to the heat development section, and a cooling section for cooling the heat development recording material having been heat developed in the heating section. The heating section is constructed by aligning a plural number of heating units having a heat plate and plural press rolls aligned therein along the conveyance direction of the heat development recording material. The heat development recording material is held between the heat plate and the press rolls, heated at a development temperature while being conveyed, and then transported into the cooling section. The cooling section is constructed of a plural number of roll pairs and cools the developed heat development recording material to approximately room temperature at a prescribed cooling rate.

According to the thus constructed heat development recording device, the development is smoothly and surely carried out without causing an abrupt temperature change (an abrupt temperature reduction) in the heat development recording material, thereby preventing uneven development, generation of a wrinkle caused by an abrupt temperature reduction and a lowering of the image quality from occurring.

In addition to the above-described heat development recording device, JP-A-9-307767 relates to the present invention.

The density of a photosensitive material at the time of heat development rises with an increase of the heat development temperature. Accordingly, in order to obtain a stable density, it is necessary to precisely control the heat development temperature and the time from substantial start to completion of the development (substantial heat development time). On the other hand, a heat development recording device is required to have readiness of rise temperature and temperature stability even at the time of first start-up of the device on a day. However, in usual PID control or on-off control, though the temperature of a site in the vicinity of a heater becomes stable fast, the temperature response of sites far from the heater becomes slow due to heat conduction, heat capacity, heat dissipation, etc. For example, if recording is carried out immediately after start-up of the device and before the heat development section has not been sufficiently warmed yet, there is caused a phenomenon in which the density is lowered. This is because even if the heater reaches the target temperature, the press rolls, etc. in the surroundings thereof are not sufficiently warmed yet. For this reason, even if the heater temperature has reached the target temperature after start-up of the device, it is necessary to make the device in the recordable state after the elapse of a certain time. However, since the temperature of the press rolls, etc. depends upon the operation history of the device, it was difficult to specify a waiting time. Also, it may be considered to set up the heater temperature immediately after the start-up high. However, even in this case, since the temperature depends upon the operation history of the device, it was difficult to specify to what extent the temperature should be raised.

That is, in the case where the heat development recording device is considered as a heat storage medium, its accumulated heat quantity changes by the operation history, and the temperature of sites far from the temperature sensor is affected by the varied heat accumulation temperature. Therefore, it was difficult to precisely control the temperature in the heat development section.

On the other hand, it may be considered to align a number of temperature sensors. However, not only the device became complicated, but also a load of the control processing increased, resulting in a delay of the development processing time. Also, it may be considered to correct the exposure amount through a variety of correction processing, thereby coping with a reduction of the density. However, even in this case, a load of the control processing increased, resulting in a delay of the development processing time. Further, it may be considered to construct a device provided with a stabilized very large heat storage medium as heating means. However, if the heat development recording device is constructed such that it is provided with such a heat storage medium, not only the whole of the device becomes large, but also the device costs become high. On the other hand, if it fails to precisely control the heat development temperature, a stable density was not obtained, resulting in generating a reduction of the image quality such as occurrence of uneven density.

SUMMARY OF THE INVENTION

An object of the present invention is to provide a heating control method of a heat development recording device capable of performing judgment based on behavior of a heat fluctuation from the time of the last start-up to the time of the present start-up and a heat development recording device, thereby designing to prevent a reduction of the density at a necessary and minimum waiting time.

The object can be attained by adoption of the following constitution, thereby achieving the invention.

(1) A heating control method of a heat development recording device, comprising:

heating a heat development section to a target temperature by a heater after a start-up of the heat development recording device;

holding the target temperature for a prescribed time after the heater has reached the target temperature;

setting up the heat development section in a recordable state after the target temperature has been held for the prescribed time, wherein operation history information from a last start-up of the heat development recording device is collected, and the prescribed time is determined based on the operation history information.

According to this heating control method of a heat development recording device, a heat fluctuation from the time of the last start-up to the time of the present start-up is collected as operation history information, and by making this operation history information by reference, it becomes possible to perform judgment based on behavior of the heat fluctuation. That is, heat history (namely, increase and decrease with a lapse of time) which has hitherto been excluded from the subject of the judgment becomes understandable. In this way, it becomes possible to grasp an accumulated heat quantity of the device which is a difference between the whole heat amount applied to the device by a heater and a heat dissipation amount, thereby making it possible to determine a more precise temperature holding time.

(2). The heating control method as described in (1), wherein the prescribed time is set up in such a manner that in a case where an elapsed time from a completion of a last operation is short, the prescribed time is short and that in a case where an elapsed time from a completion of the last operation is long, the prescribed time is long.

According to this heating control method of a heat development recording device, in the case where an elapsed time from the time of completion of the operation is short, the heat accumulation by the last operation contributes to shortening of the present temperature holding time, and in the case where an elapsed time from the time of completion of the operation is long, a heat corresponding to the heat amount as reduced by heat dissipation is compensated.

(3). The heating control method as described in (1), wherein the prescribed time is set up according to a temperature holding time set up at the last time.

According to this heating control method of a heat development recording device, by referring to the temperature holding time set up at the last time, operation history information at the time of the last start-up but one referred to for setting up the last temperature holding time falls within the range of subject of the judgment, and the behavior of the heat fluctuation of the device is judged by longer operation history information.

(4). The heating control method as described in (1), wherein the prescribed time is set up depending on whether or not the temperature holding time has elapsed after reaching the target temperature at a time of the last start-up.

According to this heating control method of a heat development recording device, the presence or absence of a lapse of the temperature holding time at the time of the last start-up is added to the subject of judgment, and it becomes possible to grasp an assumed accumulated heat quantity (assumed accumulated heat quantity that is not an actually measured amount). That is, when the device is started up and stopped before the elapse of the temperature holding time at the last time, the accumulated heat quantity is small, and after the elapse of the temperature holding time, the accumulated heat quantity is large. In this way, it becomes possible to take the accumulated heat quantity of the device, which could not be considered in the conventional heating control method in which only whether or not the temperature has reached the target temperature is the subject of the judgment, into consideration.

(5). A heat development recording device in which a heat development section is heated to a target temperature by a heater after a start-up of the heat development recording device; the target temperature is held for a prescribed time after the heater has reached the target temperature; and the heat development section is set up in a recordable state after the target temperature has been held for the prescribed time, the heat development recording device comprising:

a temperature sensor for detecting at least a temperature of the heater, a history information storage section for storing a start-up and stop information of the heat development recording device and a detected value of the temperature sensor along with an elapsed time as operation history information, and a control section for computing the prescribed time depending on the operation history information stored in the history information storage section.

According to this heat development recording device, the temperature holding time is computed by the control section depending upon the operation history information stored in the history information storage section. For example, the computation is carried out by determining a basic holding time correlated to the heater temperature as a correction curve or a function and obtaining a value of the basic waiting time specified by an arbitrary heater temperature. Accordingly, it becomes to set up and judge the temperature holding time based on behavior of the heat fluctuation from the time of the last stand-up to the time of the present stand-up. In this way, the accumulated heat quantity of the device which has not been included in the subject of the judgment so far is taken into consideration. Also, it becomes possible to heat control the temperature of other sites depending upon the operation history (for example, press rolls placed in a position far from the temperature sensor), which cannot be detected directly by the temperature sensor.

(6). The heat development recording device as described in (5), comprising a press roll for pressing a heat development recording material to the heater of the heat development section, wherein the press roll is rotation driven during start-up of the heat development recording device.

According to this heat development recording device, when the press roll is rotation driven during the start-up, the press roll is uniformly warmed so that unevenness of the temperature disappears. In this way, in particular, immediately after start-up of the device, a temperature reduction of the heat development recording material caused by contact with a low temperature site of the press roll is prevented.

(7). The heat development recording device as described in (6), wherein the press roll is intermittently-driven.

According to this heat development recording device, in comparison with the case where the press roll is continuously driven, it is possible to reduce a drive consumptive electrical power of the press roll in proportion to the intermittent drive. Also, it becomes possible to make the temperature of the press roll uniform.

According to the heating control method of a heat development recording device of the present invention, operation history information at the time of the last start-up is collected after start-up of the heat development recording device, and the temperature holding time after reaching the target temperature at the time of the present start-up is determined depending upon this operation history information. Accordingly, it becomes possible to perform the judgment based on behavior of the heat fluctuation from the time of the last start-up to the time of the present start-up, and the accumulated heat quantity of the device, which has not been included in the subject of the judgment so far, is taken into consideration so that a precise temperature holding time can be determined. As a result, not only it is possible to prevent a reduction of the density which is liable to occur immediately after start-up of the device, but also it is possible to start up the heat development recording device at a necessary and minimum waiting time.

The heat development recording device according to the invention is provided with a temperature sensor for detecting at least the temperature of the heater, a history information storage section for storing start-up and stop information of the heat development recording device and a detected value of the temperature sensor along with an elapsed time as operation history information, and a control section for computing a temperature holding time after reaching the target temperature at the time of the present start-up depending upon the operation history information stored in the history information storage section. Accordingly, when the control section performs computation depending on the operation history information stored in the history information storage section, it becomes possible to perform the judgment based on behavior of the heat fluctuation from the time of the last start-up to the time of the present start-up. Accordingly, the accumulated heat quantity of the device which has not been included in the subject of the judgment so far is taken into consideration. Also, it becomes possible to heat control the temperature of other sites depending upon the operation history, which cannot be detected directly by the temperature sensor. As a result, a more precise temperature holding time can be determined; a reduction of the density which is liable to occur immediately after start-up of the device can be prevented; and the heat development recording device can be started up at a necessary and minimum waiting time.

DETAILED DESCRIPTION OF THE INVENTION

Preferred embodiments of the heating control method of a heat development recording device and the heat development recording device according to the invention will be described below with reference to the accompanying drawings.

Figure 1:
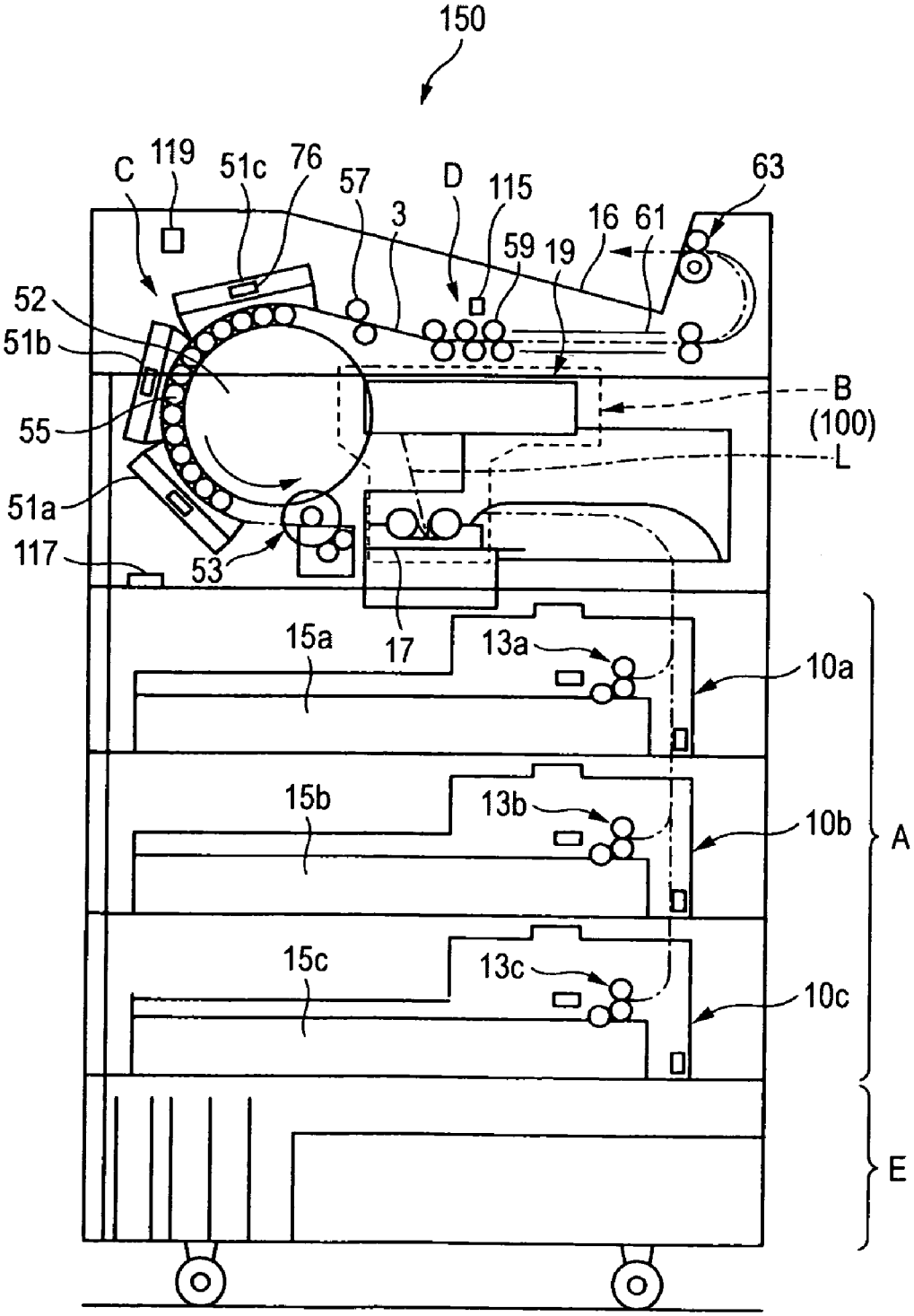
FIG. 1 is a schematic constructive view of the heat development recording device according to the invention.

FIG. 1 is a schematic constructive view of the heat development recording device according to the invention.

A heat development recording device 150 is a device in which using a heat development recording material which does not require wet development processing, the heat development recording material is exposed with by means of scan exposure with light beams composed of laser light to form a latent image, which is then heat developed to obtain a visible image, followed by cooling to the room temperature. This heat development recording device 150 is basically-provided with a heat development recording material feed section A, an image exposure section (laser recording unit 100) B, a heat development section C, and a cooling section D in the order of the conveyance direction of the heat development recording material. Also, the heat development recording device 150 is provided with conveyance means for conveying the heat development recording material provided at important points among the respective sections and a power supply/control section E for driving and controlling the respective sections.

This heat development recording device 150 is constructed in such a manner that the power supply/control section E is aligned in the lowermost stage, the heat development recording material feed section A is aligned above the power supply/control section E, and the image exposure section B, the heat development section C and the cooling section D are further aligned above the power supply/control section E, in which the image exposure section B and the heat development section C are aligned closed to each other. According to this construction, an exposure step and a heat development step can be carried out within a short conveyance distance, and a conveyance path length of the heat development recording material can be made shortest, whereby an output time per sheet can be shortened. Also, it becomes possible to simultaneously carry out both steps of the exposure step and the heat development step against one sheet of heat-development recording material.

As the heat development recording material, a photothermographic material or a photosensitive heat-sensitive material can be used. The photothermographic material is a recording material in which an image is recorded (exposed) by light beams (for example, laser beams) and then heat developed to cause color formation. Also, the photosensitive heat-sensitive material is a recording material in which an image is recorded by light beams and then heat developed to cause color formation, or an image is recorded by a heat mode (heat) of laser beams to simultaneously cause color formation and then fixed upon light irradiation.

The heat development recording material feed section A is a portion in which every one sheet of heat development recording material is discharged and supplied into the image exposure section B positioned in the downstream of the conveyance direction of the heat development recording material and is constructed of three charging sections 10*a*, 10*b*, 10*c*, feed roll pairs 13*a*, 13*b*, 13*c* aligned in respective charging sections, and non-illustrated conveyance rolls and conveyance guides. Also, magazines 15*a*, 15*b*, 15*c* containing a varied heat development recording material (for example, B4-size and HANGIRI-size) are respectively inserted inside the charging sections 10*a*, 10*b*, 10*c* as the three-stage construction, and either one of the size or direction as charged in each stage can be selectively used.

Incidentally, the foregoing heat development recording material is processed into a sheet form and usually made a laminate (bundle) of a prescribed unit of 100 sheets, etc., which is then packed by a bag, a band, etc. to form a package. Each package is contained in the magazine and charged into the respective stage of the heat development recording material feed section A.

The image exposure section B scan exposes the heat development recording material having been conveyed from the heat development recording material section A with light beams L in the major scanning direction and conveys it in the sub-scanning direction (i.e., conveyance direction) substantially perpendicular to the major scanning direction, thereby recording a desired image on the heat development recording material to form a latent image.

The heat development section C subjects the scan exposed heat development recording material to temperature elevation treatment while conveying it, to carry out heat development. Then, in the cooling section D, the developed heat development recording material is cooled and discharged into a discharge tray 16.

Figure 2:
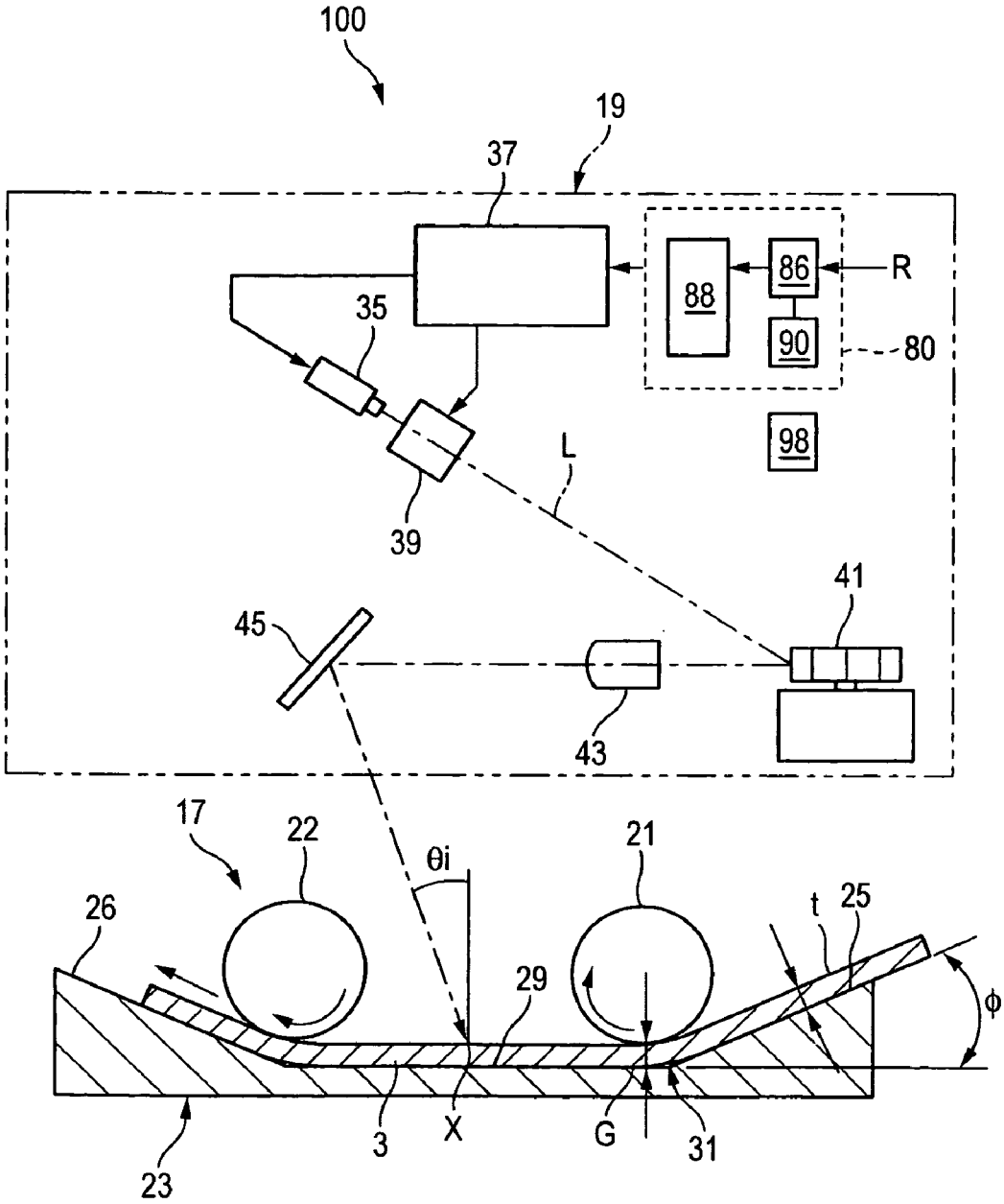
FIG. 2 is a detailed explanatory view of an image exposure section of the heat development recording device shown in FIG. 1.

Now, the image exposure section B which is a laser recording device 100 will be specifically described below. FIG. 2 is a constructive view to show a schematic construction of a sub-scanning conveyance section for conveying the heat development recording material in the sheet form and a scan exposure section in the laser recording device 100.

The image exposure section B which is a laser recording device 100 is a site for exposing the heat development recording material by scan exposure with light beams and is provided with a sub-scanning conveyance section (sub-scanning means) 17 having a mechanism of preventing flutter of conveyance while preventing flutter from the conveyance face of the heat development material and a scan exposure section (laser irradiation means) 19. The scan exposure section 19 scans (performs major scanning) laser while controlling an output of the laser according to a separately prepared image data. At this time, the heat development recording material is moved in the sub-scanning direction by the sub-scanning conveyance section 17.

The sub-scanning conveyance section 17 is provided with two drive rolls 21, 22 aligned in such a manner that a major scanning line of laser light to be irradiated is sandwiched therebetween and their axis lines are substantially in parallel against the scanning line; and a guide plate 23 supporting a heat development recording material 3, which is aligned opposing to these drive rolls 21, 22. The guide plate 23 is provided with slope portions 25, 26 of warping the heat development recording material 3 to be inserted between the guide plate 23 and the respective drive rolls 21, 22 along a part of each of the peripheral faces of the drive rolls outside a space between the drive rolls; and a press portion 29 composed of substantially parallel planes for receiving a rebound caused by the warp of the heat development recording material between the drive rolls upon contact therewith.

The slope portion 25 is an inclined face connected bent in the boundary portion with the press portion 29, and a crossing angle $\phi$ between the slope portion 25 and the press portion 29 is set up in the range of from 0° to 45°. The slope portion 26 in the downstream side of conveyance is similarly formed, and an inclined face with the foregoing crossing angle $\phi$ against the press portion 29 is provided. Incidentally, the incline face bent with a crossing angle $\phi$ larger than 0° may be provided at least in the upstream side of the conveyance direction.

The drive roll 21 receives a drive force of non-illustrated drive means such as a motor via transmission means such as gears and belts and is rotated in the clockwise direction in FIG. 2. Incidentally, the drive roll 22 having the same construction as the drive roll 21 is provided for discharging the heat development recording material 3 at the boundary position between the slope portion 26 and the press portion 29.

The drive roll 21 will be described below as an example. The drive roll 21 is aligned opposing to a bending portion 31 as a boundary portion between the press portion 29 and the slope portion 25. It is preferable that the alignment position of the drive roll 21 against to the guide plate 23 falls within the range where a straight line passing through the bending portion (turning point of angle) of the guide plate 23 and dividing an internal angle ($180°-\phi$) of the guide plate comes into contact with the external periphery of the drive roll 21. Incidentally, the relation between a diameter of the drive roll 21 and a length of the guide plate 23 is not particularly limited.

Also, the drive roll 21 is aligned in such a manner that a prescribed gap G is formed between the peripheral face thereof and the guide plate 23. It is preferable that this gap G is in the range of from en equal thickness to a 10-fold thickness of the wall thickness (t) of the heat development recording material 3 ($t \leqq G \leqq 10t$).

In the construction of the foregoing sub-scanning conveyance section 17, when the heat development recording material 3 enters from the tip of the slope portion 25, the tip of the heat development recording material 3 comes into the space between the guide plate 23 and the drive roll 21. At this time, since the press portion 29 and the slope 25 of the guide plate 23 are bent at a prescribed angle $\phi$, when the heat development recording material 3 moves into the press portion 29 from the slope portion 25, it warps, and a rebound is generated in the heat development recording material itself by this warp. By this rebound, a prescribed friction force is generated between the heat development recording material 3 and the drive roll 21, and a conveyance drive force is surely transmitted into the heat development recording material 3 from the drive roll 21, thereby conveying the heat development recording material 3.

Incidentally, when the heat development recording material 3 comes into the space between the guide plate 23 and the drive roll 21, since the gap G between the drive roll 21 to be rotated in the clockwise direction and the guide 23 is set up in the range of from en equal thickness to a 10-fold thickness of the wall thickness (t) of the heat development recording material 3, vibration of the drive roll 21 caused by disturbance, etc. does not affect the conveyance of the heat development recording material 3. That is, in the case where the foregoing disturbance is generated, since the disturbance is absorbed by an elastic force (displacement in the wall thickness direction), it does not affect the conveyance.

And, by the slope portion 26 and the drive roll 22, even at the time of discharge of the heat development recording material from the guide plate 23, a prescribed friction force is generated between the heat development recording material 3 and the drive roll 26 by a rebound caused by bending of the heat development recording material 3, whereby the heat development recording material 3 is surely conveyed. Also, in the press portion 29, the heat development recording material 3 is pressed onto the press portion 29 by the rebound of the heat development recording material 3, whereby flutter of the heat development recording material 3 from the conveyance face, namely flutter in the vertical direction, is suppressed. By irradiating laser light on the heat development recording material 3 between the drive rolls, it is possible to achieve good recording free from a deviation of the exposure position.

On the other hand, as illustrated in FIG. 2, the scan exposure section 19 polarizes laser light L modulated depending upon an image signal in the major scanning direction and makes it incident at a prescribed recording position X and is provided with a laser light source 35 for injecting laser light of a narrow wavelength region (wavelength: 350 nm to 900 nm) depending upon spectral sensitivity characteristics of the heat development recording material, a recording control unit 37 for driving the laser light source 35, a cylindrical lens 39, a polygon mirror 41 as a light polariscope, an fθ lens 43, and a cylindrical mirror 45 for last transition.

Incidentally, besides, various optical members to be aligned in known light beam scan exposure devices, such as a collimator lens and a beam expander for forming light beams injected from the laser light source 35, an optical face tangle error correction for laser scanning system, and a mirror for optical path adjustment are aligned, if desired in the scan exposure section 19. Also, the recording beam diameter of the laser light on the heat development recording material 3 is set up at from ϕ50 to ϕ200 μm. In particular, it is preferable that the recording beam diameter in the sub-scanning direction is small because the interference region is reduced.

Here, the image recording is carried out by pulse width modulation as an exposure mode. The recording control unit 37 drives the laser light source 35 by pulse width modulation depending upon the recorded image and injects light beams having been pulse width modulated depending upon the recorded image. The laser light L injected from the laser light source 35 is polarized in the major scanning direction by the polygon mirror 41 and light modulated by the fθ lens 43 so as to form an image at the recording position X, and made incident at the recording position X at a prescribed incident angle θi upon selection of an optical path by the cylindrical mirror 45. That is, the laser light L is irradiated against the heat development material 3 at an incident angle θi having an inclination of from 4° to 15° in the sub-scanning direction from the normal of the heat development recording material 3 within a plane in parallel to the normal direction and sub-scanning direction (conveyance direction) of the heat development recording material.

An image data from an image data supply source R such as CT and MRI is sent to an image processing unit 80. The image processing unit 80 is composed of a combination of various image processing circuits and memories and constructed of a density correction section 86 for carrying out density correction and an image processing section 88 for carrying out a variety of image processing such as sharpness correction. In the image processing unit 80, an image data (image information) is received from the image data supply source R and subjected to a variety of correction and processing, whereby it is converted into a heat-sensitive recorded image date corresponding to heat-sensitive recording. Also, a built-in densitometer measured value correction section 90 (hereinafter referred to as "measured value correction section 90") is connected in the density correction section 86. Input means 98 is connected in the measure value correction section 90, and the input means 98 makes it possible to input the density measurement results of a standard chart measured by an external densitometer into the measured value correction section 90.

The density correction section 86 receives an image data of an image to be recorded from the image data supply source R, subjects the image data to density correction, and outputs the corrected image data into the image processing section 88. Also, this density correction section 86 outputs a standard chart for setting up a density calibration condition and sets up a density calibration condition depending upon the density measurement results of the standard chart by a built-in densitometer.

Next, the heat development section C will be described below.

The heat development section C heats a heat development recording material to be heated, which is of a type to which heat treatment is applied. With respect to the construction of the heat development section C, as illustrated in FIG. 1, a plural number of plate heaters 51*a*, 51*b*, 51*c* lined in the conveyance direction of the heat development recording material, as heating bodies which will reach a temperature necessary for processing the heat development recording material 3, are curved, and these plate heaters 51*a*, 51*b*, 51*c* are aligned in the series of arc shape.

That is, with respect to the construction of the heat development section C including these plate heaters 51*a*, 51*b*, 51*c*, as illustrated, each plate heater is provided with an concave curve, and the heat development recording material 3 is slipped and relatively moved while bringing the heat development recording material 3 into contact with the concave curve of each plate heater. At this time, as conveyance means of the heat development recording material 3, a feed roll 53 and a plural number of press rolls 55 which also function for achieving heat conduction into the heat development recording material 3 from each plate heater are aligned.

Figure 3:
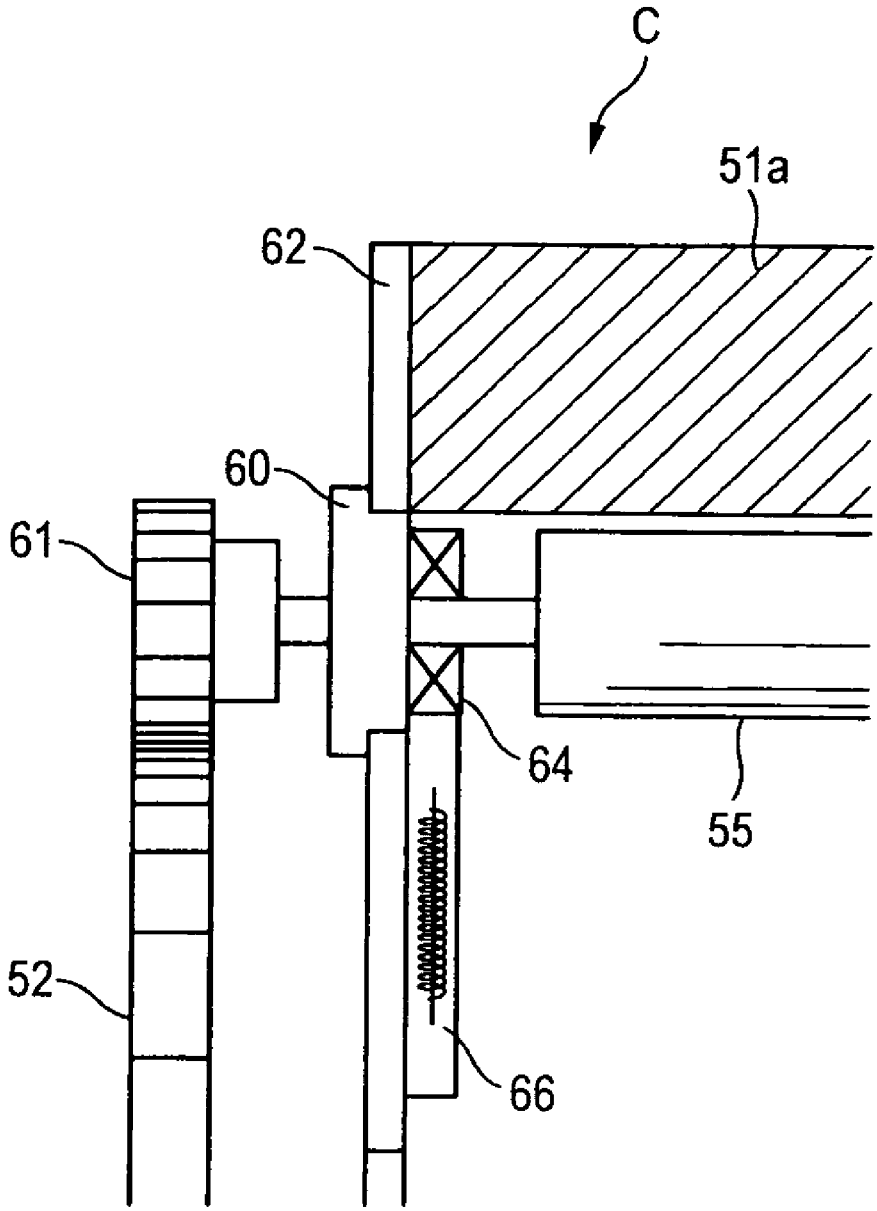
FIG. 3 is an enlarged view of a press roll drive mechanism section of a heat development section.

FIG. 3 is an enlarged view of a press roll drive mechanism section of the heat development section.

Here, since each of the plate heaters 51*a*, 51*b*, 51*c* is structurally identical with the corresponding press roll 55, the plate heater 51*a* will be described below as an example. The press roll 55 is supported by a support member 60 in its end in the axis direction, and a driven gear 61 is provided in the axis end. A press roll drive gear 52 is rotatably pivoted by a non-illustrated frame in the center of the arc alignment of the press roll 55. The press roll drive gear 52 is engaged with the driven gear 61. The press roll drive gear 52 is rotated by a non-illustrated main drive gear supported by a frame in the lower portion of the heat development section C.

The press roll 55 is rotatably supported by a bearing 64 of a support member 60 fixed on a heating body side plate 62. In the support member 60 and the bearing 64, the press roll 55 is constructed in such a manner that it is movable in the direction of the plate heater 51*a* by a prescribed amount. And, when the heat development recording material 3 is conveyed into a gap between the press roll 55 and the plate heater 51*a*, the gap is spread. On the other hand, since the bearing 64 is biased by the biasing member 66 in the direction of the plate heater 51*a*, a desired pressure is given to the heat development recording material 3, thereby making it possible to realize gap-free contact with the plate heater 51*a*. By this construction, since the heat development recording material 3 to be conveyed is conveyed while being pressed onto the plate heaters 51*a*, 51*b*, 51*c*, buckling of the heat development recording material 3 can be prevented from occurring. And, discharge rolls 57 for transporting the heat development recording material 3 are aligned in the end terminal of the conveyance path within the heat development section C.

In the state where the heat development recording material 3 does not enter, the press roll drive gear 52 and the driven gear 61 are aligned in the position relationship that they are closed to each other but not engaged with each other. And, when the heat development recording material 3 enters, as described previously, the gap between the press roll 55 and the plate heater 51*a* is spread, and conversely, the driven gear 61 becomes engaged on a pitch circle of the press roll 55. By such an alignment, the press roll 55 which does not grasp the heat development recording material 3 is not rotated, whereby a drive load of the press roll drive gear 52 can be reduced. The gap between the press roll 55 and the plate heater 51*a*, which is held in the state that the heat development recording material 3 does not enter, is set up slightly narrow as compared with the thickness of the heat development recording material 3. For example, when the thickness of the heat development recording material 3 is 0.2 mm, the gap between the press roll 55 and the plate heater 51*a* is suitably about 0.15 mm. In this case, it is preferable that the movable amount of the axis of the press roll 55 is from about 0.05 to 0.65 mm.

As the structure of a heater portion of the plate heater 51*a*, there is enumerated a construction in which a metal plate opposing to the press roll 55 is provided, and in the back side of that opposing face, a stratiform silicon rubber is laminated via a heating wire pattern. In bonding these members, by integrally molding the metal plate and an unvulcanized silicon rubber heater, vulcanization of the silicon rubber heater and its bonding to the metal plate are carried out at a stretch. By such steps, it is possible to achieve uniform adhesion between the silicon rubber heater and the metal plate without forming a gap. Accordingly, matters caused by abnormal heating in the case where a gap space enters, such as melting and burning of the silicon rubber, do not occur.

Figure 4:
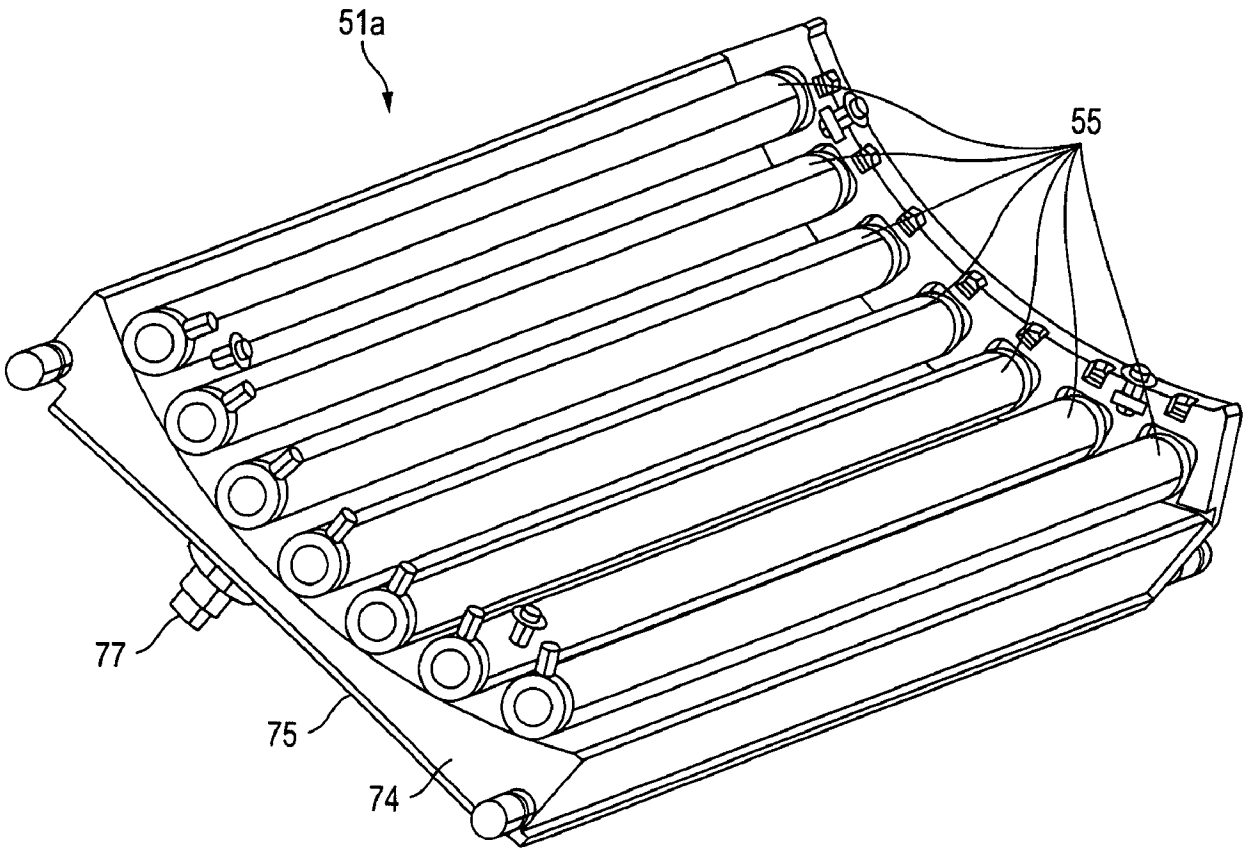
FIG. 4 is an enlarged perspective view of a plate heater.

FIG. 4 is an enlarged perspective view of the plate heater.

The plate heater 51*a* is provided with an aluminum-made guide plate 74, a silicon rubber heater 75, a plural number of thermistors 76 (see FIG. 5) as a temperature sensor, a heater terminal protector 77, and press rolls 55. The aluminum-made guide plate 74 is formed in the concave shape against the traveling direction of the heat development recording material 3. The press rolls 55 are aligned in the plural number (seven) over the widthwise direction of the aluminum-made guide plate 74 and at equal intervals in the traveling direction and work to convey the heat development recording material 3 having been transported onto the concave while pressing it onto the concave.

Figure 5:
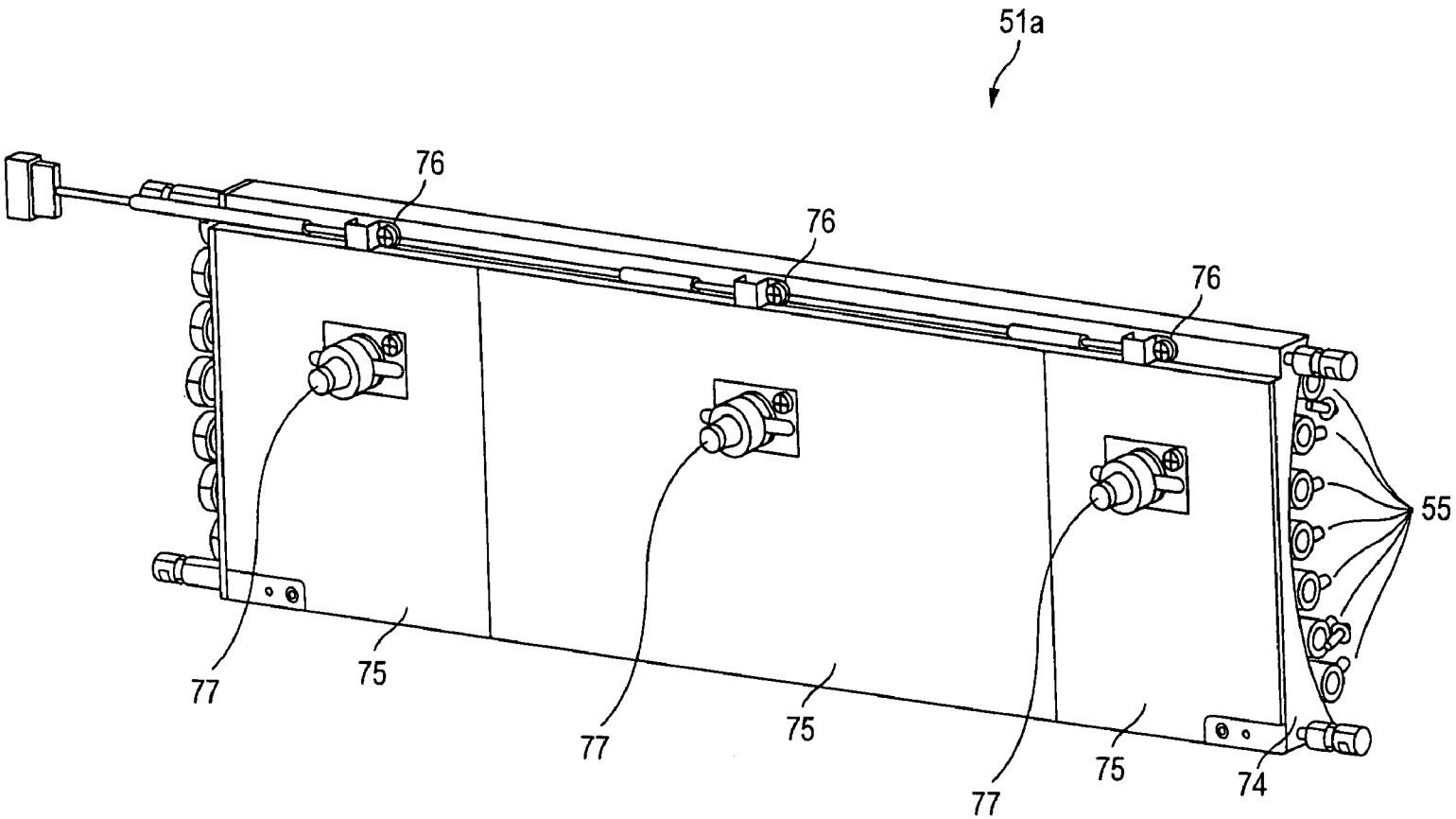
FIG. 5 is a perspective view to show the back side of an aluminum-made guide plate.

FIG. 5 is a perspective view to show the back side of the aluminum-made guide plate.

Three sheets of the silicon rubber heater 75 are provided in the back side (opposite to the concave) of the aluminum-made guide plate 74 in the widthwise direction. The thermistor 76 is installed in the edge of the respective silicon rubber heater 75. That is, three sheets of the silicon rubber heater 75 are used for every one of the plate heaters 51*a*, 51*b*, 51*c*, and nine sheets of the silicon rubber heater 75 are used in total, and one thermistor 76 is provided for every silicon rubber heater 75. And, the nine silicon rubber heaters 75 are independently controlled by the respective corresponding thermistor 76.

Figure 6:
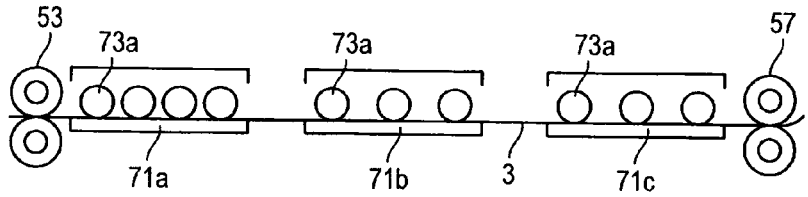
FIG. 6 is a constructive view to show a modification of the heat development section.

As a matter of course, the foregoing curved plate heater is one embodiment, and constructions provided with an endless belt and a peel claw using other flat plate heater or heating drum may be employed. That is, for example, as illustrated in FIG. 6, a construction provided with a plural number of flat heaters 71*a*, 71*b*, 71*c* aligned at intervals in the linear direction on the same plane and a plural number of pairs of roll groups 73*a*, 73*b*, 73*c* aligned opposite to the flat heaters 71*a*, 71*b*, 71*c* and transporting the heat development recording material 3 in the linear direction while sandwiching it from the front and back sides may be employed.

The heat development recording material 3 having been conveyed out from the heat development section C is cooled in the cooling section D while taking care such that it does not generate a wrinkle and that it does not get into a habit of crook. A plural number of cooling roll pairs 59 are aligned within the cooling section D so as to give a desired constant curvature R to the conveyance path of the heat development recording material 3. This means that the heat development recording material 3 is conveyed at a constant curvature until the heat development recording material 3 is cooled to not higher than the glass transition point of the material thereof. By intentionally imparting a curvature to the heat development recording material 3, excessive curling disappears before the heat development recording material 3 is cooled to not higher than the glass transition point. When the heat development recording material 3 becomes not more than the glass transition point, curling is not newly imparted, and the curling amount does not scatter.

Also, the cooling roll pair 59 itself and the internal atmosphere of the cooling section D are temperature adjusted. Such temperature adjustment is carried out in a manner that the state after thoroughly carrying out running is equal to the state immediately after start-up of the device as far as possible and thereby it is effective for making a density fluctuation small.

And, the heat development recording material 3 which has been cooled to not higher than the glass transition point in the cooling section D is guided into a cooling plate 61, further cooled therein to a temperature at which even when touched by fingers, a skin burn is not caused, and finally discharged into the discharge tray 16 through a discharge roll pair 63.

Figure 7:
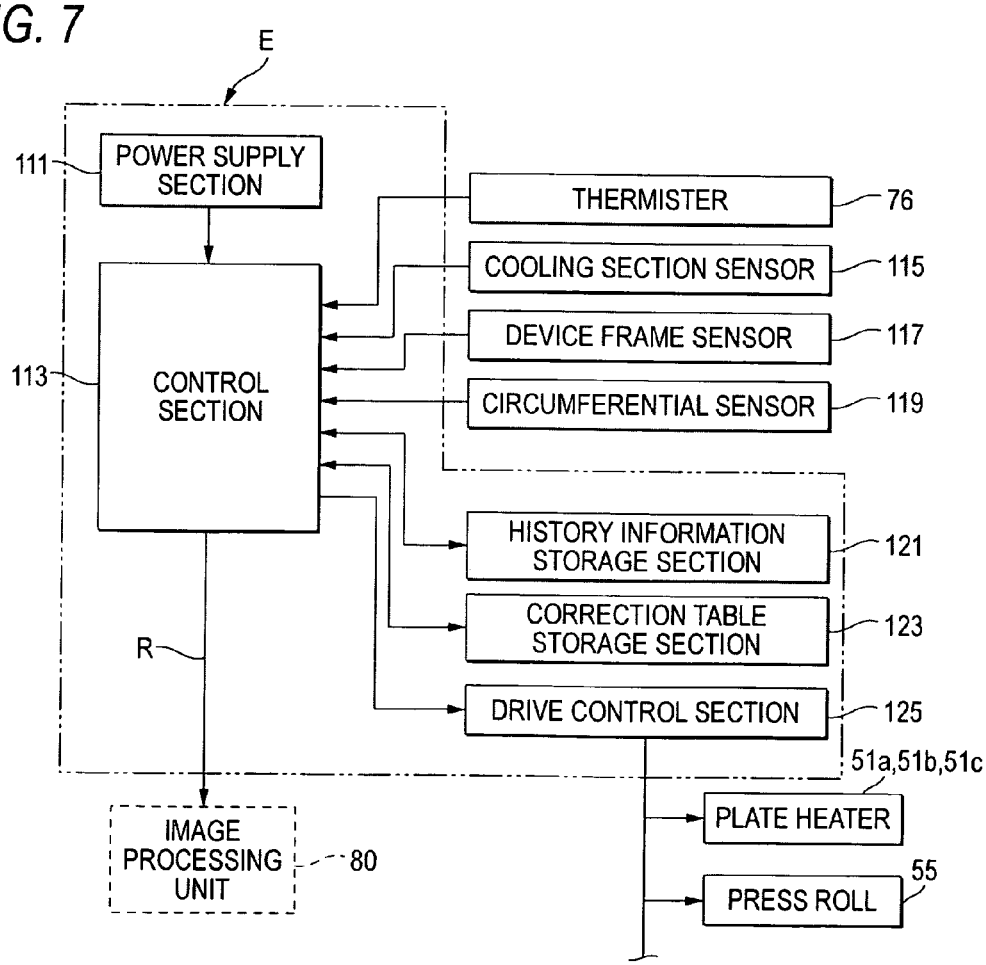
FIG. 7 is a block diagram of a power supply/control section.

FIG. 7 is a block diagram of a power supply/control section.

The power supply/control section E is roughly classified into a power supply section 111 and a control section 113 having CPU. The powder supply section 111 supplies an electric power to the control section 113 and other drive sections. The control section 113 relays an image data supplied from the image data supply source R such as CT and MRI and sends it to the image processing unit 80. Also, the control section 113 can not only drive and control the heat development recording material feed section A, the image exposure section B, the heat development section C, the cooling section D, and the conveyance drive system but also compute the temperature holding time after reaching the target temperature at the time of start-up. Besides the foregoing thermistor 76, an cooling section sensor 115 for detecting the temperature of the cooling section D, a device frame sensor 117 for detecting the temperature of a device frame, and a circumferential sensor 119 for detecting the circumferential temperature of the deice are connected in the control section 113, and temperature detection signals are input from these sensors.

Also, a history information storage section 121 is connected in the control section 113, and the history information storage section 121 stores start-up and stop information in the past in the heat development recording device 150 and the detected values of the respective temperature sensors along with the elapsed time as operation history information. The control section 113 computes the temperature holding time after reaching the target temperature at the time of the present start-up depending upon the operation history information stored in the history information storage section 121. A correction table storage section 123 is connected in the control section 113, and the correction table storage section 123 makes it possible to store a correction function obtained by the computation, for example, a correction curve represented by the correlation between the heater temperature and the basic waiting time and a variety of correction coefficients. And, a drive control section 125 is connected in the control section 113, and the drive control section 125 receives a drive control signal from the control section 113 and sends the drive control signal to the plate heaters 51*a*, 51*b*, 51*c*, the press roll drive mechanism, and so on so as to ensure the computed temperature holding time.

Incidentally, with respect to the image recording for the heat development recording material 3, details are described in, for example, WO 95/31754 and WO 95/30934, and these patent documents may be made hereof by reference, if desired.

In the heat development recording device 150, after start-up, the heat development section C is heated by the plate heaters 51*a*, 51*b*, 51*c* to the target temperature, and after the plate heaters 51*a*, 51*b*, 51*c* have reached the target temperature, the target temperature is held for a prescribed time, whereby the heat development section C is set up in the recordable stable. The time when the target temperature is held for a prescribed time is referred to as "temperature holding time" in the present specification and claims. The temperature holding time is computed by the control section 113 depending upon the operation history information stored in the history information storage section 121. For example, this computation is carried out by determining the basic waiting time correlated to the heater temperature as a correction curve or a function and obtaining a value of the basic waiting time as specified by an arbitrary heater temperature. Accordingly, it becomes possible to set up and judge the temperature holding time based on behavior of the heat fluctuation from the time of the last start-up to the time of the present start-up. In this way, the accumulated heat quantity of the device which has not been included in the subject of the judgment so far is taken into consideration, and it becomes possible to heat control the temperature of other site (for example, the press roll 55 placed at a position far from the thermistor 76) which cannot be detected directly by a temperature sensor and depends upon the operation history.

According to this heat development recording device 150, since at least the temperature sensor (thermistor 76) which detects the temperature of the plate heaters 51*a*, 51*b*, 51*c*, the history information storage section 121 which stores start-up and stop information in the past in the heat development recording device 150 and the detected values of the respective temperature sensors along with the elapsed time as operation history information, and the control section 113 which computes the temperature holding time after reaching the target temperature at the time of the present start-up depending upon the operation history information stored in the history information storage section 121 are provided, when the control section 113 carries out the computation depending upon the operation history information stored in the history information storage section 121, it becomes possible to achieve the judgment based on behavior of the heat fluctuation from the time of the last start-up to the time of the present start-up. Accordingly, the accumulated heat quantity of the device which has not been included in the subject to the judgment so far is taken into consideration, and it becomes possible to estimate the temperature of other site which cannot be detected directly by a temperature sensor and depends upon the operation history. As a result, it becomes possible to more precisely determine the temperature holding time. Also, it is possible to prevent a reduction of the density which is liable to occur immediately after start-up of the device and to start up the heat development recording device 150 at a necessary and minimum waiting time.

Next, the heating control method by the thus constructed heat development recording device 150 will be described below.

Figure 8:
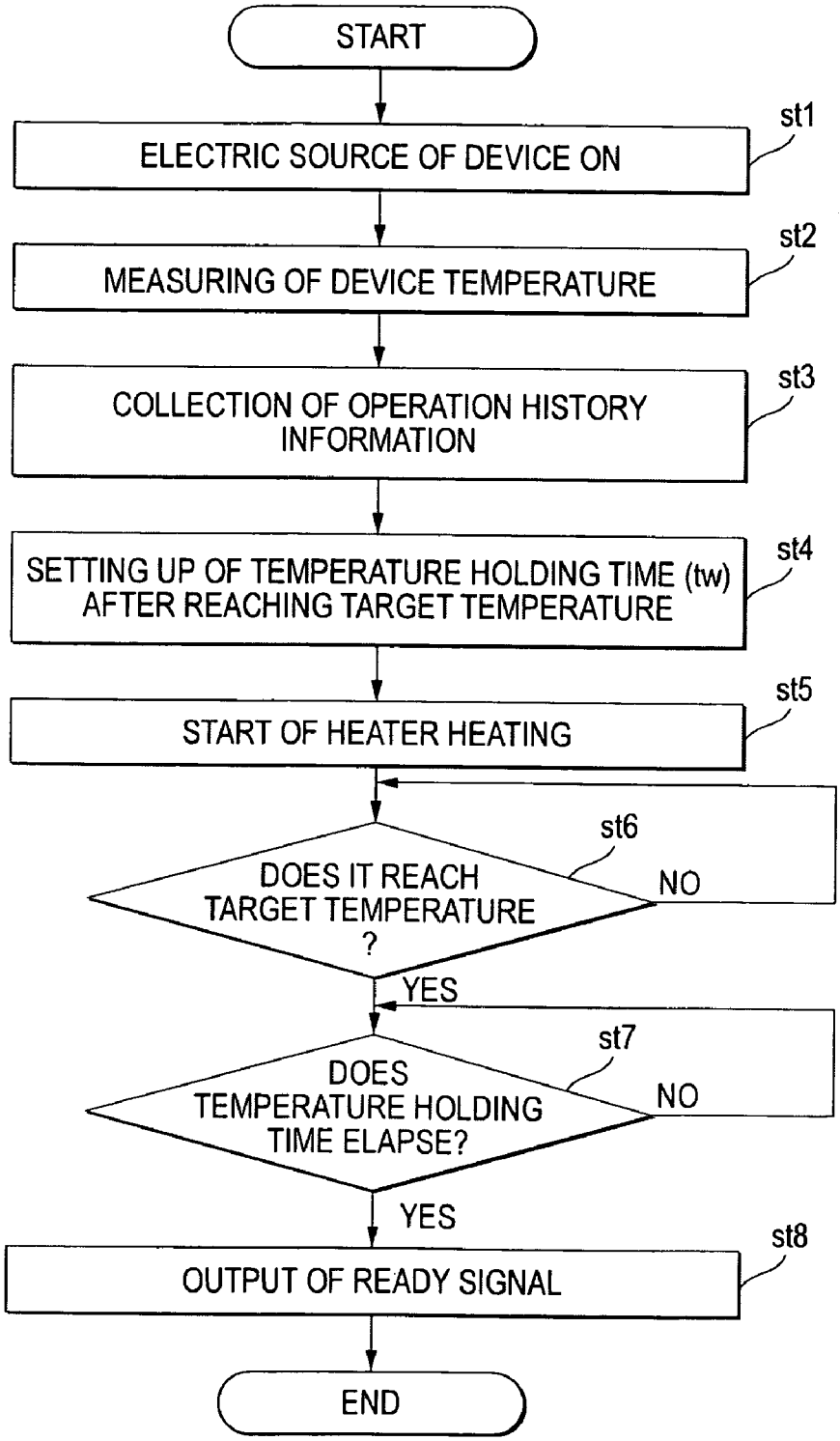
FIG. 8 is a flow chart to show the procedures of the heating control method.

FIG. 8 is a flow chart to show the procedures of the heating control method.

As the basic procedures, this heating control method includes a heating step for heating the heat development section-C-after start-up of the heat development recording device 150 to the target temperature by the plate heaters 51*a*, 51*b*, 51*c*; and a temperature holding step for holding the target temperature after the plate heaters Sa, 51*b*, 51*c* have reached the target temperature for a prescribed time. And, after holding the target temperature for a prescribed time, the heat development section C is set up in the recordable state. Setting up the temperature holding time after reaching the target temperature at the time of the present start-up, an aspect of which is a characteristic feature of the invention, is carried out depending upon the operation history information collected after start-up of the heat development recording device 150 as described below in detail.

That is, when the electric source of the heat development recording device 150 is turned on (st1), first of all, the device temperature is detected by the control section 113 via the thermistor 76, the cooling section sensor 115, the device frame sensor 117 and the circumferential sensor 119 (st2). The control section 113 stores this detected value of temperature and the start-up and stop information along with the elapsed time as operation history information in the history information storage section 121. After completion of the storage, the operation history information stored in the history information storage section 121 is again read out by information collection processing of the control section 113 (st3).

The control section 113 sets up the temperature holding time (sometimes referred to as "waiting time tw") after reaching the target temperature at the time of the present start-up based on the read-out operation history information (st4).

Figure 10:
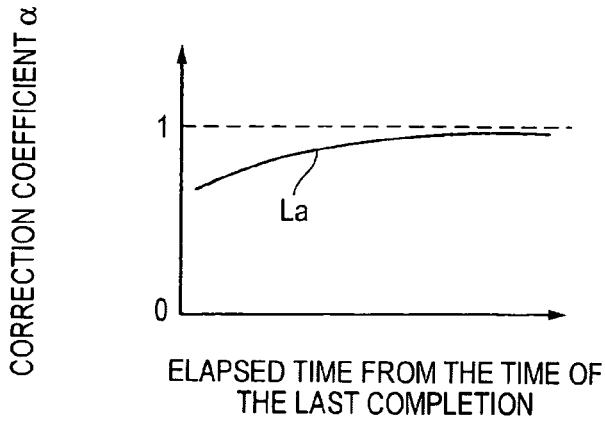
FIG. 10 is a graph to show a correlation between a correction coefficient and an elapsed time.

FIG. 10 is a graph to show a correlation between the correction coefficient and elapsed time from the time of the last completion.

The waiting time tw is determined according to the following expression.

$$tw=\alpha \cdot t_0 \quad (1)$$

wherein $\alpha$ represents a correction coefficient correlated to the elapsed time from the time of the last completion; and $t_0$ represents a basic waiting time from which these fluctuation factors have been eliminated.

Figure 9:
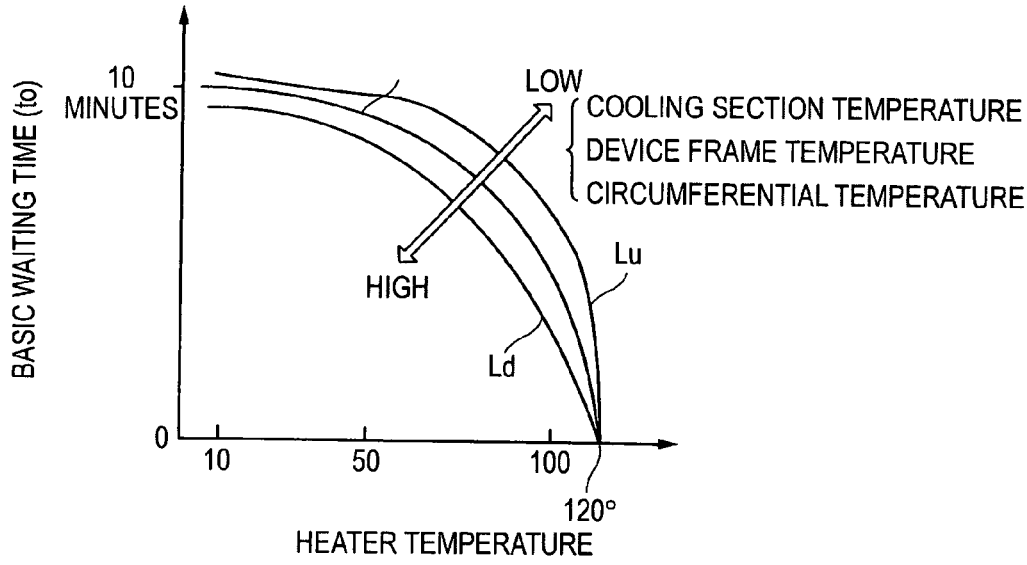
FIG. 9 is a graph to show a correlation between the basic waiting time and the thermistor temperature.

FIG. 9 is a graph to show a correlation between the basic waiting time and the thermistor temperature.

The basic waiting time to has a correlation (correction curve Lm) with the temperature of the plate heaters 51*a*, 51*b*, 51*c* as detected by the thermistor 76 as shown in FIG. 9. The basic waiting time to becomes short with an increase of the heater temperature and when the heater temperature reaches the target temperature, for example, 120° C., becomes minimal. Also, this correction curve Lm changes depending upon the detected value of temperature of the cooling sensor 115, the device frame sensor 117 and the circumferential sensor 119. That is, in the case where the detected value by these sensors is high, the correction curve Lm is shifted in the Ld side; and in the case where the detected value is low, the correction curve Lm is shifted in the Lu side. These correction curves are stored in the correction table storage section 123.

Figure 11:
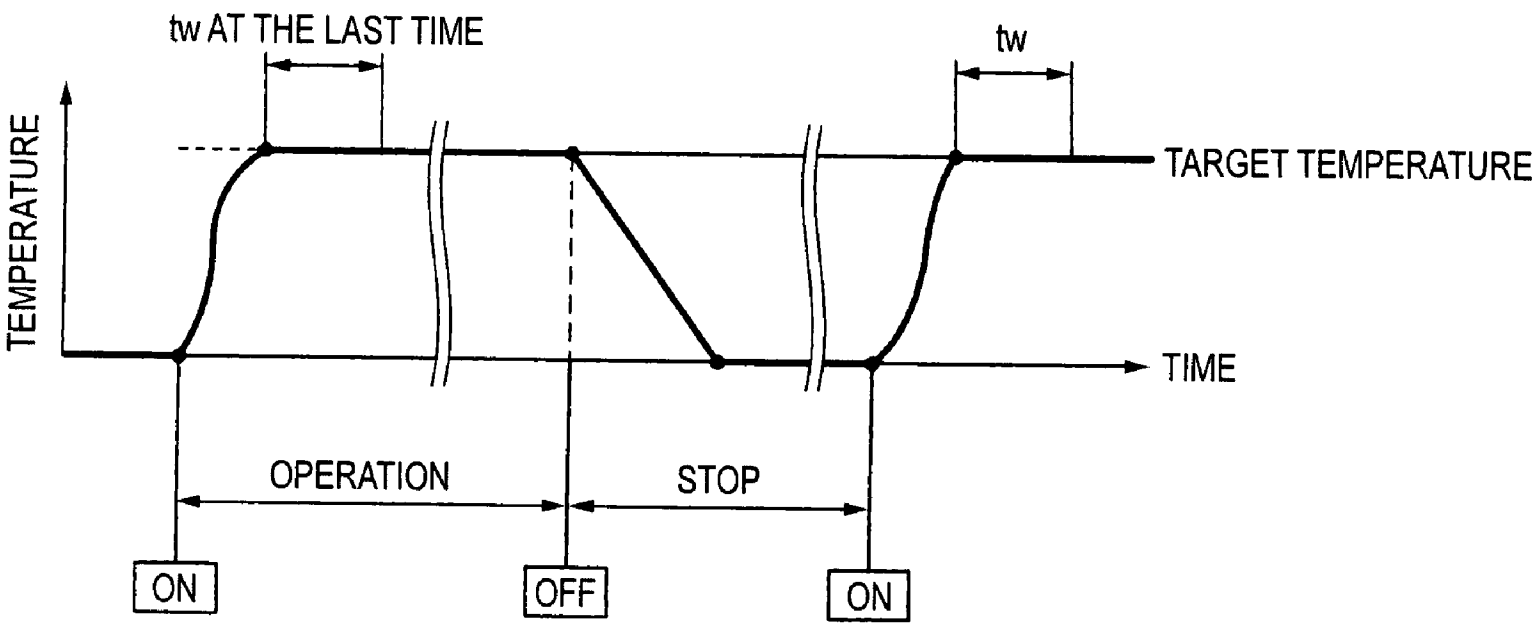
FIG. 11 is a time chart to show the temperature change in the case of waiting until the waiting time (temperature holding time).
Figure 12:
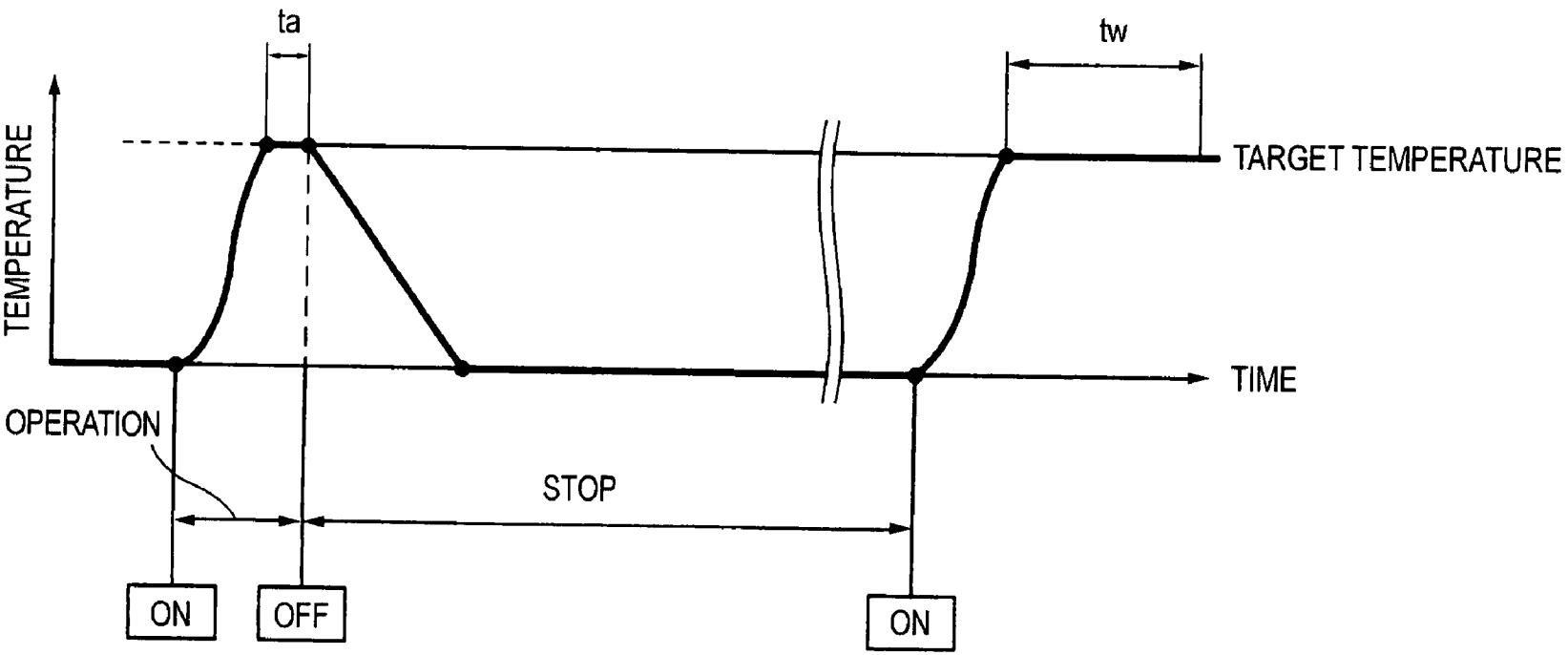
FIG. 12 is a time chart to show the temperature change in the case of not waiting until the waiting time.

FIG. 11 is a time chart to show the temperature change in the case of waiting until the waiting time (temperature holding time); and FIG. 12 is a time chart to show the temperature change in the case of not waiting until the waiting time.

It is preferable that the temperature holding time is set up depending upon whether or not the temperature holding time has elapsed after reaching the target temperature at the time of the last start-up. That is, the accumulated heat quantity of the device is different between the case of waiting for a prescribed waiting time tw at the time of the last start-up as shown in FIG. 11 and the case where nevertheless need of waiting until a prescribed waiting time tw after reaching the target temperature has elapsed, the device is turned off at a waiting time ta as shown in FIG. 12. According to the conventional control, since only whether or not the temperature is raised to the target temperature was judged, this difference of the accumulated heat quantity was not taken into consideration.

On the other hand, when the temperature holding time is set up depending upon whether or not the temperature holding time has elapsed after reaching the target temperature at the time of the last start-up, the presence or absence of a lapse of the temperature holding time at the time of the last start-up is taken into consideration so that it becomes possible to grasp the assumed accumulated heat quantity (assumed accumulated heat quantity that is not an actually measured amount). That is, when the device is started up and stopped before elapse of the temperature holding time, the accumulated heat quantity is small; and when the temperature holding time has elapsed, the accumulated heat quantity is large. In this way, the accumulated heat quantity of the device which could not be taken into consideration according to the conventional heating control method in which only whether or not the temperature has reached the target temperature is subject of the judgment is taken into consideration. As a result, for example, it becomes possible to grasp the state of a shortage of the accumulated heat quantity as generated by start-up and stop of the device before elapse of the temperature holding time at the last time, whereby a reduction of the density immediately after the start-up caused due to a shortage of the heat quantity can be prevented.

Figure 13:
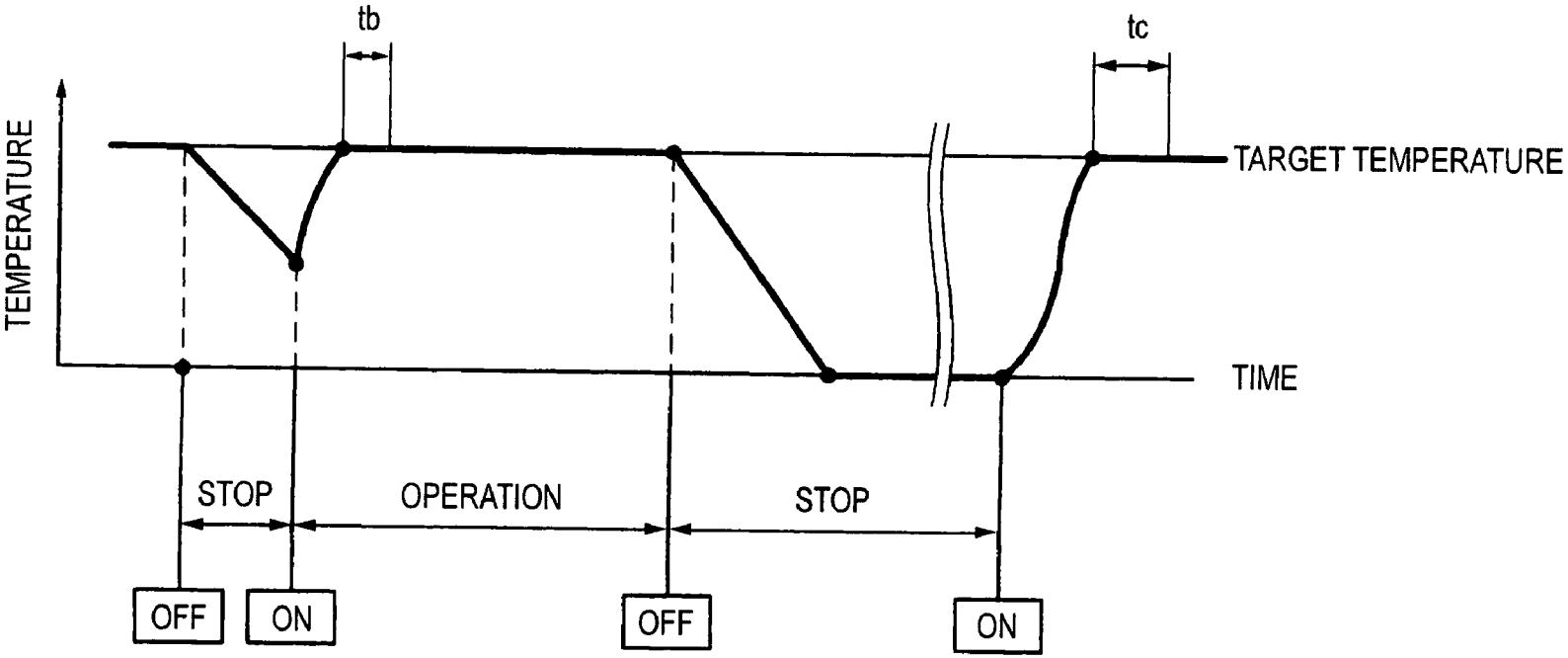
FIG. 13 is a time chart of the temperature change in the case where after the last device turning-off but one, the device is turned on at the last time before it has not be fully cooled.

FIG. 13 is a time chart of the temperature change in the case where after the last device turning-off but one, the device is turned on at the last time before it has not be fully cooled.

Further, it is preferred to set up the temperature holding time depending upon the last set up temperature holding time. In this way, when the last set up temperature holding time is made by reference, the operation history information at the time of the last start-up but one, which has been made by reference for setting up the last temperature holding time, also falls within the range of the subject of the judgment, and the behavior of the heat fluctuation of the device is judged by longer operation history information. For example, as shown in FIG. 13, if after the last device turning-off but one, the device is turned on at the last time before it has not be fully cooled, the last waiting time tb is shorter than the usual waiting time tw. The present waiting time tc is set up by making this by reference.

In this way, by setting up the temperature holding time depending upon the last set up temperature holding time, the operation history information at the time of the last start-up but one as referred to for setting up the last temperature holding time is also taken into consideration, whereby it becomes possible to set up a more precise temperature holding time.

When the waiting time tw is set up in this way, the control section 113 sends a heater drive signal to the drive control section 125, and the plate heaters 51*a*, 51*b*, 51*c* having received the drive signal from the drive control section 125 start heating (st5).

Next, when what the temperature has reached the target temperature is judged by the respective sensors (st6), counting of the waiting time tw is started. When a lapse of the waiting time tw is completed (st7), an output signal of "Ready" display is sent to the drive control section from the control section 113 (st8); a "Ready" display is made on an operation panel of the heat development recording device 150; and the heat development section C is set up in the recordable state.

In this heating control method of the heat development recording device 150, the heat fluctuation from the time of the last start-up to the time of the present start-up is collected as operation history information, and by making this operation history information by reference, it becomes possible to perform judgment based on behavior of the heat fluctuation. That is, heat history (namely, increase and decrease with a lapse of time) which has hitherto been excluded from the subject of the judgment becomes understandable. In this way, it becomes possible to grasp an accumulated heat quantity of the device which is a difference between the whole heat amount applied to the device by a heater and a heat dissipation amount, thereby making it possible to determine a more precise temperature holding time. As a result, not only it is possible to prevent a reduction of the density which is liable to occur immediately after start-up of the device, but also it is possible to start up the heat development recording device 150 at a necessary and minimum waiting time.

Next, other embodiment of the heat development recording device will be described below.

Figure 14:
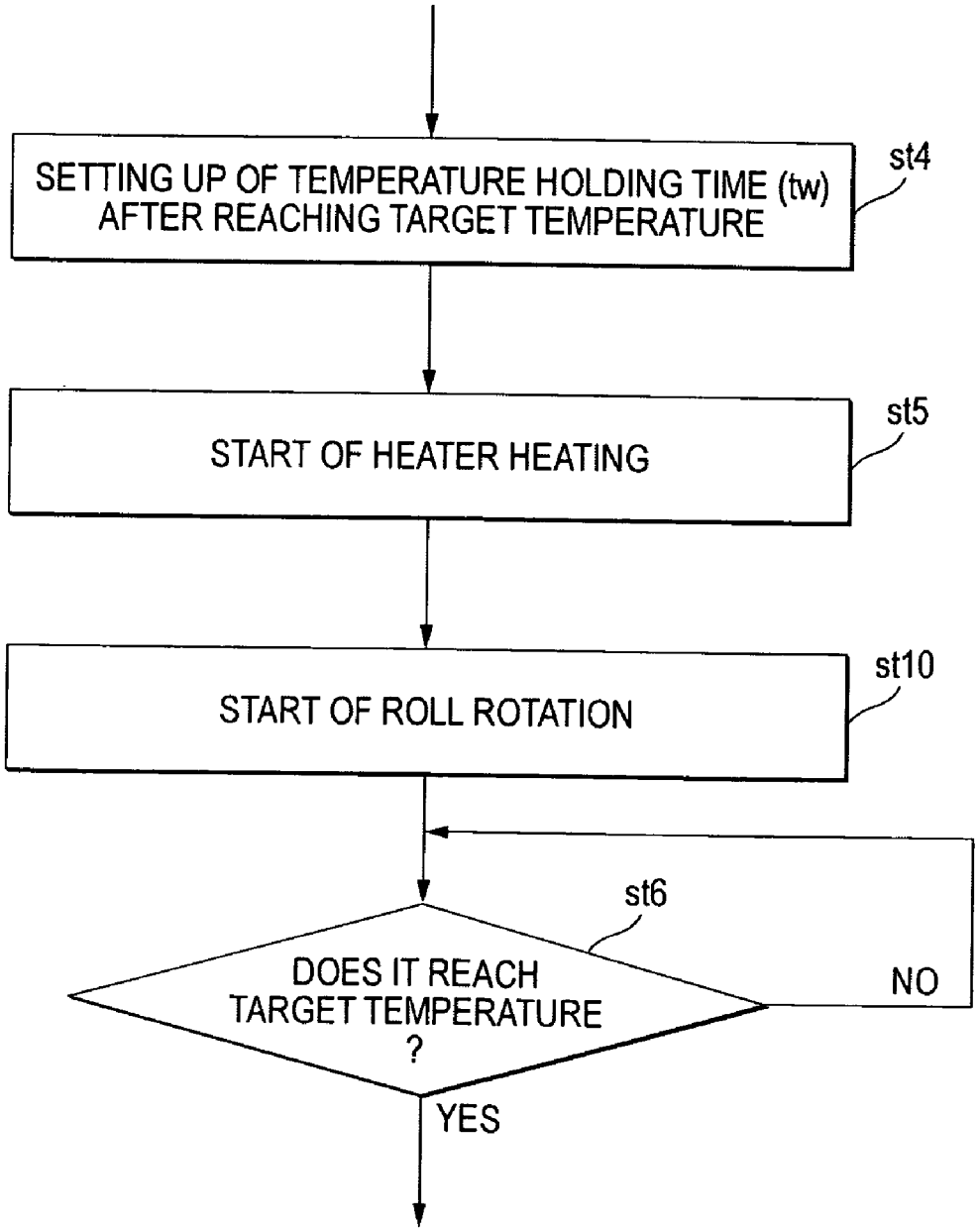
FIG. 14 is a flow chart to explain the actuation of a heat development recording device of another embodiment.

FIG. 14 is a flow chart to explain the actuation of a heat development recording device according to other embodiment. Incidentally, the processing identical to the processing shown in FIG. 8 is given the same step symbol (st), and overlapping explanation is omitted.

In the heat development recording device according to this embodiment, the press rolls aligned for the purpose of pressing the heat development recording material 3 onto the plate heaters 51*a*, 51*b*, 51*c* of the heat development section C is rotation driven during start-up of the heat development device (st10). In the rotation drive, a drive start signal is sent to the drive control section 125 from the control section 113 at the same time of start-up of the device, and the drive control section 125 having received this drive start signal drive controls the press rolls.

Accordingly, when the press roll 55 is rotation driven during the start-up, the press roll 55 is uniformly warmed so that unevenness of the temperature disappears. In this way, in particular, immediately after start-up of the device, a temperature reduction of the heat development recording material 3 caused by contact with a low temperature site of the press roll 55 is prevented.

Also, the press roll 5 may be one to be intermittently driven. By performing such intermittent drive control, in comparison with the case where the press roll 55 is continuously driven, it is possible to reduce a drive consumptive electrical power of the press roll 55 in proportion to the intermittent drive. Also, it becomes possible to make the temperature of the press roll uniform.

According to this heat development recording device, since the press roll 55 is rotation driven during the start-up of the heat development recording device 150, the press roll 55 is uniformly warmed, whereby a phenomenon of a reduction of the density due to a reduction of the temperature immediately after start-up of the device is largely improved. As a result, in comparison with the case of continuous drive, it is possible to reduce a drive consumptive electrical power. Especially, this heat development recording device is effective for controlling in the case where it is impossible to simultaneously pass electricity through all of drive sections in view of restrictions on the electric capacity as in 100-volt instruments (heat development recording device in which a primary side voltage to be supplied into the power supply section 111 is approximately 100 V) and so on.

Incidentally, in the heat development recording device 150, in the case as in 100-volt instruments and so on, there may be the possibility that all of the plate heaters 51*a*, 51*b*, 51*c* cannot be turned on in view of the capacity. In such a case, it is desired that the usual temperature control after "Ready" is carried out in a frequent on/off control as far as possible. On the other hand, at the time of start-up of the device, if the plural plate heaters 51*a*, 51*b*, 51*c* are subjected to on/off control frequently and alternately too much, the efficiency of heat conduction drops, resulting in a problem that the rise time of the device becomes slow.

On the other hand, according to the foregoing heat development recording device 150, it is possible to change the on/off period at the time of usual temperature control and at the time of temperature control at the time of start-up of the device based on the operation history information. For example, the on/off control of a 1.2-second period is employed at the time of usual temperature control, and the on/off control of a 6-second period is employed at the time of start-up of the device. In this way, the temperature can be controlled with good precision at the usual time, and device can be started up within a short time at the time of start-up.

The present invention is not limited to the specific above-described embodiments. It is contemplated that numerous modifications may be made to the present invention without departing from the spirit and scope of the invention as defined in the following claims.

What is claimed is:

1. A heating control method of a heat development recording device, comprising:

heating a heat development section to a target temperature by a heater after a start-up of the heat development recording device;

holding the target temperature for a prescribed time after the heater has reached the target temperature;

setting up the heat development section in a recordable state after the target temperature has been held for the prescribed time, wherein operation history information from a last start-up of the heat development recording device is collected, and the prescribed time is determined based on the operation history information.

2. The heating control method according to claim 1, wherein the prescribed time is set up in such a manner that in a case where an elapsed time from a completion of a last operation is short, the prescribed time is short and that in a case where an elapsed time from a completion of the last operation is long, the prescribed time is long.

3. The heating control method according to claim 1, wherein the prescribed time is set up according to a temperature holding time set up at the last time.

4. The heating control method according to claim 1, wherein the prescribed time is set up depending on whether or not the temperature holding time has elapsed after reaching the target temperature at a time of the last start-up.

5. A heat development recording device in which a heat development section is heated to a target temperature by a heater after a start-up of the heat development recording device; the target temperature is held for a prescribed time after the heater has reached the target temperature; and the heat development section is set up in a recordable state after the target temperature has been held for the prescribed time, the heat development recording device comprising:

a temperature sensor for detecting at least a temperature of the heater, a history information storage section for storing a start-up and stop information of the heat development recording device and a detected value of the temperature sensor along with an elapsed time as operation history information, and a control section for computing the prescribed time depending on the operation history information stored in the history information storage section.

6. The heat development recording device according to claim 5, comprising a press roll for pressing a heat development recording material to the heater of the heat development section, wherein the press roll is rotation driven during start-up of the heat development recording device.

7. The heat development recording device according to claim 6, wherein the press roll is intermittently driven.

* * * * *